US005285216A

United States Patent [19]

Ota et al.

[11] Patent Number: 5,285,216

[45] Date of Patent: Feb. 8, 1994

[54] THERMAL HEAD

[75] Inventors: Shigenori Ota, Aira; Tsuyoshi Yasutomi, Kokubu; Akihiro Kawata, Aira, all of Japan

[73] Assignee: Kyocera Corporation, Kyoto, Japan

[21] Appl. No.: 589,392

[22] Filed: Sep. 26, 1990

[30] Foreign Application Priority Data

Sep. 27, 1989 [JP] Japan ..... 1-113953[U]
Sep. 21, 1990 [JP] Japan ..... 2-99561[U]

[51] Int. Cl.[5] ..... B41J 2/325
[52] U.S. Cl. ..... 346/76 PH
[58] Field of Search ..... 346/76 PH

[56] References Cited

FOREIGN PATENT DOCUMENTS 61-140844 9/1986 Japan .
0078860 3/1989 Japan .
1-86546 6/1989 Japan .
1-190467 7/1989 Japan .

*Primary Examiner*—Benjamin R. Fuller
*Assistant Examiner*—Huan Tran
*Attorney, Agent, or Firm*—Spensley Horn Jubas & Lubitz

[57] ABSTRACT

When the rear side of a heat resistant substrate having heating elements formed on the front side and a cooling board are adhered with an adhesive, the heat is accumulated in the substrate. To prevent this, the portions corresponding to the heating elements on the rear side are not adhered, but are protected with cooling compound, or adhesives are applied to both sides of the cooling compound, as it is known in prior parts, but they may cause uneven heat release from the substrate to the cooling board, or sacrifice the tacky action due to wetting of the adhesive with the cooling compound. In this invention, cooling compound or cooling adhesive is spread on the rear surface corresponding to the heating elements on the substrate, and an adhesive is applied to the parts separate from that area with grooves, thereby affixing the substrate and cooling member. As a result, the layer thickness of the cooling compound or cooling adhesive may be kept constant, and excessive heating compound flows into the grooves to avoid loss of the tacky action. Thus, excellent heat release is realized, and the printing quality is enhanced.

Warps and waves of the heat resistant substrate are eliminated as being pressed and fixed to the cooling board.

13 Claims, 10 Drawing Sheets

THERMAL HEAD

BACKGROUND OF THE INVENTION

1. Field of the Invention

The present invention relates to a thermal head.

2. Description of the Prior Art

FIG. 1 is a perspective view showing a partial section of a thermal head 1 of a typical prior art, and this thermal head 1 comprises a heat resistant substrate 2 made of ceramics or the like, and plural heating resistance elements 3 are linearly disposed on one of its principal planes. The heating resistance elements 3 are selectively heated and driven by an electric constitution which is not shown in the drawing to print on a thermal paper (not shown), for example, in contact therewith. On the other hand, on the opposite side of the heating resistance elements 3 of the heat resistant substrate 2, there is a cooling board 4 made of a material excellent in thermal conductivity such as metal material, and it is adhered to the heat resistant substrate 2 with an adhesive or tacky agent (hereinafter called adhesive) 5 which possesses elasticity at least after curing.

The reason of using such adhesive 5 is as follows. When the thermal head 1 is used at room temperature of, for example, 25° C., the surface of the heat resistant substrate 2 is heated nearly to 80° C., for example, due to heat generation of the heating resistance elements 3. The heat resistant substrate 2 and cooling board 4 differ significantly in the coefficient of thermal expansion. At this time, when both are mutually fixed, the heat resistant substrate 2 and the cooling board 4 are warped in the same principle as a bimetal because of this difference. As a result, although release of heat is smooth at the mutually directly contacting position, but is poor is other positions, and uneven contrast occurs in printing. By using the adhesive 5, besides affixing the heat resistant substrate 2 on the cooling board 4, the difference in thermal expansion between the two is absorbed by the adhesive 5, thereby preventing warping of the heat resistant substrate 2.

In such thermal head 1, in the adhesive 5 satisfying such condition, the thermal conductivity is small, for example, less than $0.5\times10^{-3}$ cal/cm.sec.° C., and the heat from the heating resistance elements 3 is mostly reserved in the heat resistant substrate 2, and when the heating resistance elements 3 are driven at high speed, the printing contrast cannot be controlled due to the residual heat.

In such thermal head 1, it is known to use a cooling compound on the principal plane of the heat resistant substrate 2 instead of the adhesive.5. On the other hand, it is known that waves and warps of height difference of tens to hundreds of microns are formed in the manufacturing process of the heat resistant substrate 2. Accordingly, the layer thickness of the cooling compound 5 between the heat resistant substrate 2 and cooling board 4 differs locally, thereby causing uneven cooling effect. Therefore, when printing thermally, uneven contrast occurs.

FIG. 2 is a perspective view showing a partial section of a thermal head 1*a* of a second prior art. Relating to this thermal head 1*a*, the similar and corresponding parts of the foregoing prior art are identified with the same reference numbers. This prior art comprises a heat resistant substrate 2, heating resistance elements 3, and a cooling board 4, which are mutually fixed by bonding in a structure not shown in the drawing. In this example, in the portion of the cooling board 4 confronting the heating resistance elements 3, a cooling compound 6 is placed in a range of width W4 over the entire length in the arrangement direction of the heating resistance elements 3. A pair of long grooves 7 are formed in the cooling board 4 at positions across the cooling compound 6.

The cooling compound 6 is a mixture of fine particles of aluminum oxide or zinc oxide in a size of 1 μm or less and, for example, silicone oil, and it is a greasy matter having viscosity, and its thermal conductivity is generally 1.5 to $3.0\times10^{-3}$ cal/cm.sec.° C., and as compared with the adhesive 5 of the foregoing prior art, this mixture possesses a thermal conductivity of 3 to 6 times higher. After applying the cooling compound 6 between the long grooves 7 on the cooling board 4, when the heat resistant substrate 2 is pressed, the cooling compound 6 is compressed and spread widely on the cooling board 4, and the long grooves 7 are provided to keep this cooling compound 6.

In this prior art, by using the cooling compound 6, the heat generated from the heating resistance elements 3 is easily led out from the heat resistant substrate 2 into the cooling board 4 to be released.

In the thermal head 1*a* of such prior art, same as in the prior art explained in FIG. 1, warping occurs along the direction vertical to the sheet of paper in FIG. 2 due to the difference in the coefficient of thermal expansion between the heat resistant substrate 2 and cooling board 4. The cooling compound 6 is amorphous, and therefore the heat resistant substrate 2 and cooling board 4 fluctuate in the mutual distance due to such warping along the longitudinal direction of the thermal head 1*a*. Due to this fluctuation, heat transfer from the heat resistant substrate 2 to the cooling board 4 changes in location, and uneven contrast occurs when thermally printing on a thermal paper.

FIG. 3 is a perspective view showing a partial section of a thermal head 1*b* in a third prior art, and this example is similar to the foregoing prior arts, and corresponding parts are identified with same reference numbers, and specifically a circuit substrate 8 is mounted on the cooling board 4 aside from the heat resistant substrate 2, and they are connected by bonding wire 9. Between the cooling board 4 and heat resistant substrate 2, there is a cooling compound 6 in a range corresponding to the locations of the heating resistance elements 3, while an adhesive 5 is placed in the remaining region. A step difference 10 is formed in the boundary of the region of the adhesive 5 and the region of cooling compound 6.

In this prior art, using the cooling compound 6, the heat generated by the heating resistance elements 3 is promptly led to the cooling board 4, and by the adhesive 5 formed on the step difference part 10, the heat resistant substrate 2 is affixed to the cooling board 4, and the cooling compound 6 invades into the gap GP by capillary phenomenon, thereby preventing the state of faulty contact at the electric contact part of the circuit substrate 8. Besides, by preliminarily selecting the depth of the step difference 10, the layer thickness of the cooling compound 6 is set.

In the above prior art, the cooling compound 6 and adhesive 5 contact with each other, and in such state, however, the adhesive and the heat resistant substrate 2 and cooling board 4 contacting with the adhesive 5 are wetted with the cooling compound 6, and the adhesive action may not be realized, or be lost suddenly. Besides, the layer thickness of the cooling compound 6 is in a range of scores to hundreds of micrometers, and it is extremely difficult to form the step difference part 10 in the cooling board 4 by cutting at such high precision.

Besides, in this thermal head 1*b*, in the cooling board 4, the step difference part 10 intervals are formed as protrusions S, and the distance between the protrusions S and the heat resistant substrate 2 is set shorter than the distance from the heat resistant substrate 2 at the step difference part 10, thereby enhancing the heat releasing effect. In such prior art, however, concerning the machining precision of the cooling board 4 for forming the step difference part 10 and protrusions S, dimensional errors of, for example, about ±50 micron occur, and the dimensional fluctuations are relatively great, and therefore uneven printing contrast occurs due to reserve of heat on the heat resistant substrate 2.

SUMMARY OF THE INVENTION

It is hence a primary object of the invention to present a thermal head capable of outstandingly enhancing the printing quality by solving the above-discussed technical problems and eliminating the uneven contrast in thermal printing.

The invention presents a thermal head comprising a heat resistant substrate having plural heating elements arranged on one principal plane thereof, with a first region including the position of the rear side mounting the heating elements and a second region other than the first region existing on the heat resistant substrate, and a cooling member having grooves formed against the second region, wherein a cooling compound or a cooling adhesive having a rubbery elastisity excellent in heat conductivity is placed between the first region and the cooling member, and an adhesive is placed between the second region and cooling member.

The invention also presents a thermal head, wherein plural grooves are formed at both sides of the first region along the direction crossing with the arrangement direction of the heating elements, and plural second regions are formed further outward of the crossing direction of the grooves.

The invention further presents a thermal head, wherein protrusions of a height nearly equal to the thickness of the adehsive are disposed in the portion of the second region at the end side of the heat resistant substrate.

The invention moreover presents a thermal head, wherein the adhesive has a layer thickness of 10 micron to 150 micron, and shearing adhesion strength of 25 $kg/cm^2$ or less.

The invention also presents a thermal head, wherein the cooling compound is a greasy matter with a thermal conductivity of $1.0\times10^{-3}$ cal/cm.sec.° C. or more.

The invention further presents a thermal head, wherein the cooling adhesive is a silicone adhesive with a thermal conductivity of $1.0\times10^{-3}$ cal/cm.sec.° C. or more.

The invention still more presents a thermal head, wherein a circuit wiring for feeding driving electric power to the plural heating elements is formed on the principal plane of the heat resistant substrate, a flexible wiring substrate to be connected to this circuit wiring is disposed, and the flexible wiring substrate is supported by a reinforcing member disposed in the cooling member having nearly the same thickness at the heat resistant substrate.

The invention furthermore presents a thermal head, wherein a circuit wiring for feeding driving electric power to the plural heating elements is formed on the principal plane of the heat resistant substrate, a flexible wiring substrate connected to this circuit wiring is disposed, and protrusions are formed in a range opposite to the flexible substrate of the cooling member so as to support the flexible substrate in a flat state.

The invention presents a thermal head comprising a heat resistant substrate having plural heating elements arranged on one principal plane thereof, with a first region including the position of the rear side mounting the heating elements and a second region other than the first region existing on the heat resistant substrate, and a cooling member having grooves formed against the second region, wherein an elastic adhesive excellent in thermal conductivity is intervening between the first region and the cooling member, and an adhesive is placed between the second region and cooling member.

The invention presents a thermal head, wherein the elastic adhesive is a silicone resin adhesive with a thermal conductivity of $1.0\times10^{-3}$ cal/cm.sec.° C. to $3.0\times10^{-3}$ cal/cm.sec.° C.

The invention presents a thermal head, wherein the heat resistant substrate is made of an elastic material with a Young's modulus of $4.0\times10^{7}$ $g/mm^2$ or less.

In a thermal head according to the invention, the heat by the plural heating elements disposed on a heat resistant substrate is transmitted to the cooling member through the heat resistant substrate and cooling compound or cooling adhesive, so that quick heat transfer is realized. Therefore, even in the event of high quality printing, residue of heat on the heat resistant substrate is inhibited, and undesired printing is prevented, and the printing quality may be enhanced.

Besides, the cooling compound or cooling adhesive having a rubbery elasticity is formed between the first region corresponding to the arrangement region of the heating elements of the heat resistant substrate and the cooling member, and between the remaining second region other than the first region and the cooling member there is an adhesive layer across the grooves formed between them. If the cooling compound or the cooling adhesive is not morphous, their layer thickness can be determined by the adhesive layer, so that an adequate layer thickness for heat transfer may be realized. Besides, excessive cooling compound or cooling adhesive is designed to flow into the grooves, and wetting of the heat resistant substrate and cooling member due to flow into the second region is prevented, and the loss of adhesive action of the adhesive layer is hence prevented. In all these aspects, a cooling compound or cooling adhesive of a proper layer thickness can be placed between the heat resistant substrate and cooling member, which may contribute to enhancement of printing quality of the thermal head.

The cooling compound or cooling adhesive used in the invention has the thermal conductivity selected at $1.0\times10^{-3}$ cal/cm.sec.°C. or more, and more preferably at $1.5\times10^{-3}$ cal/cm.sec.°C. or more. If the thermal conductivity is less than $1.0\times10^{-3}$ cal/cm.sec.°C., the heat from the heating elements tends to be stagnant, and the picture quality may deteriorate.

As for the adhesive, its thickness is preferably in a range of 10 micron to 150 micron, and within this range, by the soft deformation of itself, the difference in the expansion between the heat resistant substrate and cooling member may be absorbed most effectively, thereby notably preventing the warp due to bimetal effect due to difference in the coefficient of thermal expansion along with temperature rise of printing action. It is desired to be a soft adhesive with a shearing adhesion strength of 25 kg/cm$^2$ or less. If the shearing adhesion strength exceeds 25 kg/cm$^2$, the bimetal effect occurs to cause warp.

In the thermal head of the invention, heating elements are arranged on a principal plane of the heat resistant substrate, and this heat resistant substrate comprises a first region including the positions of the back side in which the heating elements are disposed, and a second region which is the area other than the first region. A cooling member is disposed on the back side of the heat resistant substrate, and a grooves is formed between the first region and a second region on the cooling member. Between the first region of the heat resistant substrate and the cooling member, an adhesive having a rubbery elasticity excellent in thermal conductivity is intervening, and an adhesive is placed between the second region and cooling member. Furthermore, the more the thickness of the layer formed by the adhesive separates from the grooves, the thickness is smaller.

Thus, the heat resistant substrate and cooling member are elastically bonded together, if the coefficient of thermal expansion differs, although the expansion amount varies due to temperature rise or fall, as this difference is permitted. Therefore, formation of warp due to so-called bimetal effect is eliminated. In addition, between the first region and the cooling member, there is an adhesive having a rubbery elasticity excellent in thermal conductivity, and a smooth heat release from the heat resistant substrate to the cooling member is achieved. Besides, as the more the thickness of the layer formed by the adhesive separates from the grooves, the thickness is smaller, and therefore even if the heat resistant substrate is warped or waved in the manufacturing process, it is affixed to the cooling member and flattened, thereby preventing uneven heat release and occurrence of uneven contrast in thermal printing. Thus, the printing quality is outstandingly improved.

Thus, according to the invention, the cooling compound is formed between the first region corresponding to the arrangement region of the heating elements of the heat resistant substrate and the cooling member, and grooves are formed in the cooling member corresponding to the boundary between the remaining second region other than the first region and the first region, and an adhesive layer is placed between the second region and the cooling member.

Even if the cooling compound is not morphous, its layer thickness can be determined by the adhesive layer, so that an adequate layer thickness of cooling compound for heat transfer is realized. Besides, the excessive cooling compound is designed to flow into the grooves, and wetting of heat resistant substrate or cooling member due to invasion into the second region is prevented. As a result, loss of adhesive action by the adhesive layer is avoided. In all these aspects, the cooling compound of adequate layer thickness can be realized between the heat resistant substrate and cooling member, which may contribute to enhancement of printing quality of the thermal head.

According to the invention, the heat resistant substrate and cooling member are elastically bonded together, if the coefficient of thermal expansion differs, although the expansion amount varies due to temperature rise or fall, as this difference is permitted. Therefore, formation of warp due to so-called bimetal effect is eliminated. In addition, between the first region and the cooling member, there is an adhesive having a rubbery elasticity excellent in thermal conductivity, and a smooth heat release from the heat resistant substrate to the cooling member is achieved. Besides, as the more the thickness of the layer formed by the adhesive separates from the grooves, the thickness is smaller, thereby the back side near the heating elements of the heat resistant substrate is affixed to the edge of the recess of the cooling member in flat by pressing, and therefore even if the heat resistant substrate is warped or waved in the manufacturing process, it is affixed to the cooling member and flattened, thereby preventing uneven heat release and occurrence of uneven contrast in thermal printing. Thus, the printing quality is outstandingly improved.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
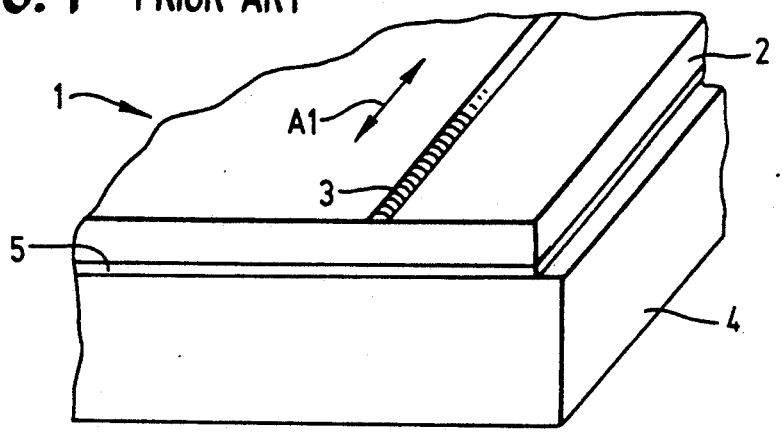
FIG. 1 PRIOR ART
FIG. 1 is a sectional view of a thermal head 1 of a typical prior art.

Now referring to the drawing, preferred embodiments of the invention are described below.

Figure 4:
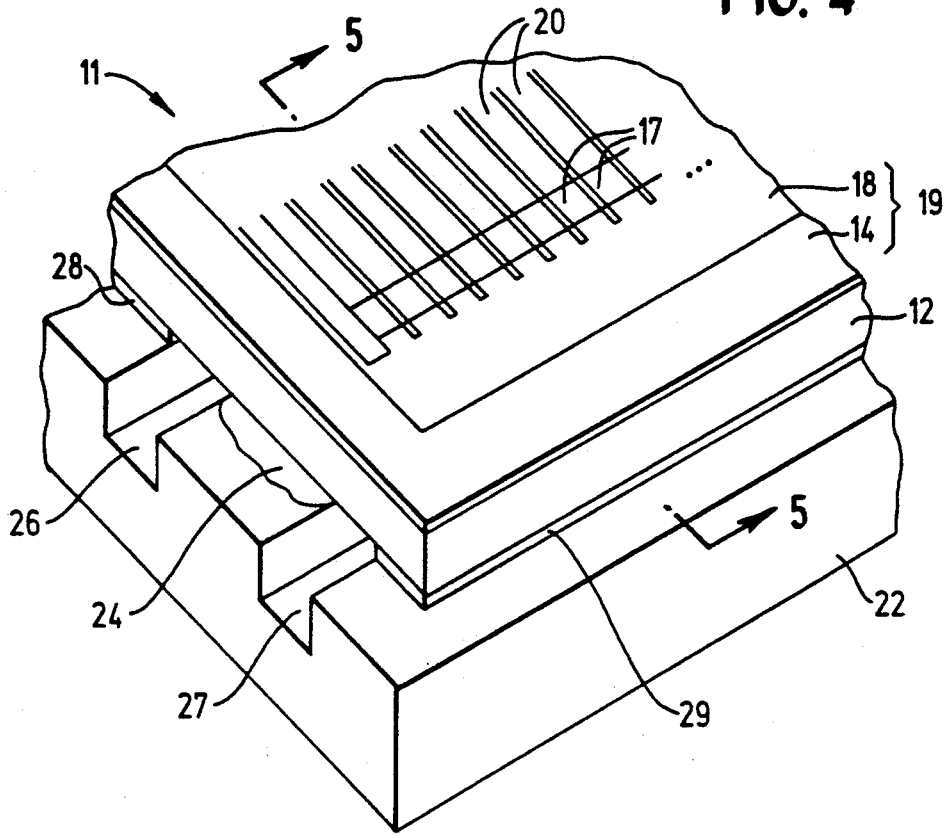
FIG. 4 is a perspective view showing a partial section of a thermal head 11 in a first embodiment of the invention.
Figure 5:
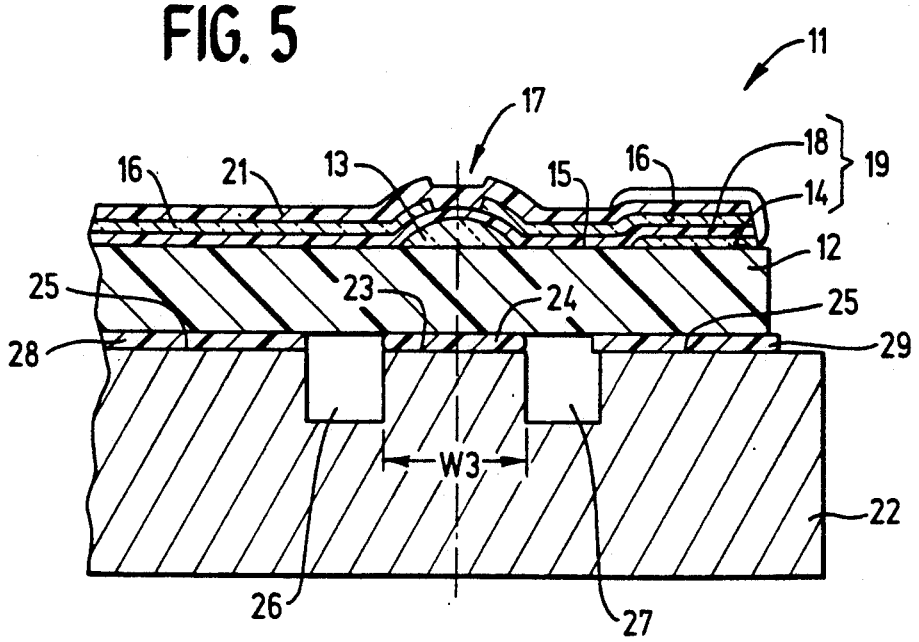
FIG. 5 is a sectional view as seen from cut section line II—II in FIG. 4.
Figure 6:
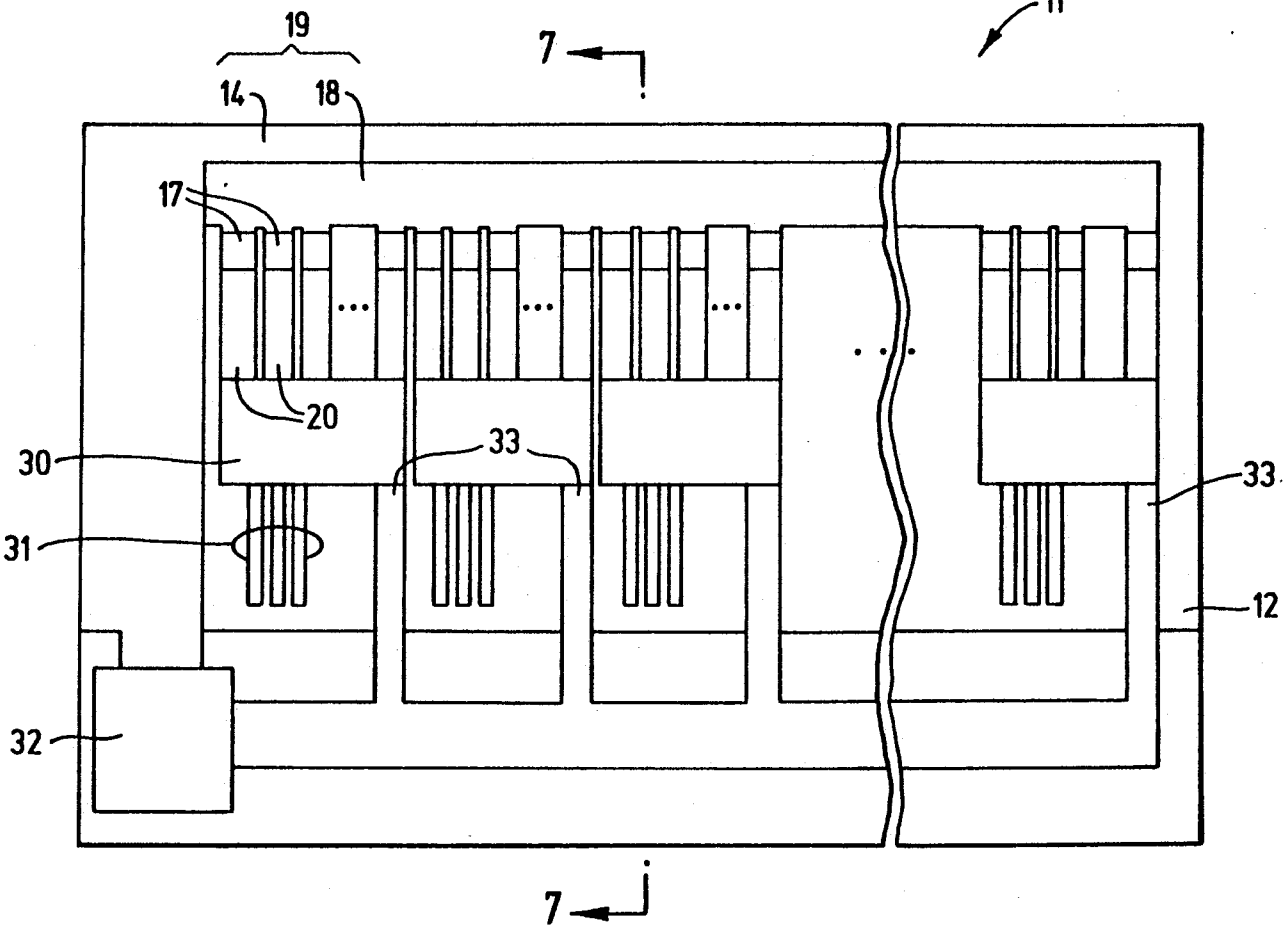
FIG. 6 is a plan view of the thermal head 11.
Figure 7:
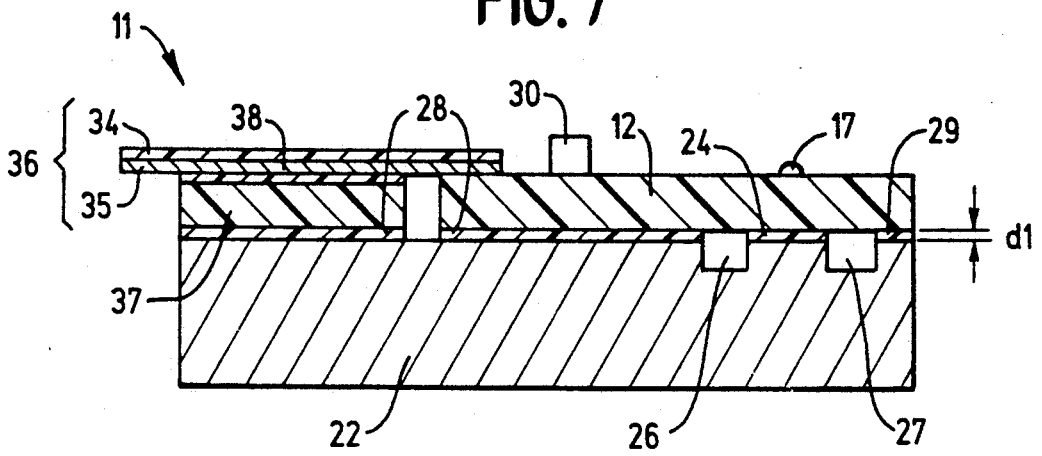
FIG. 7 is a sectional view as seen from cut section line IV—IV in FIG. 6.
Figure 8:
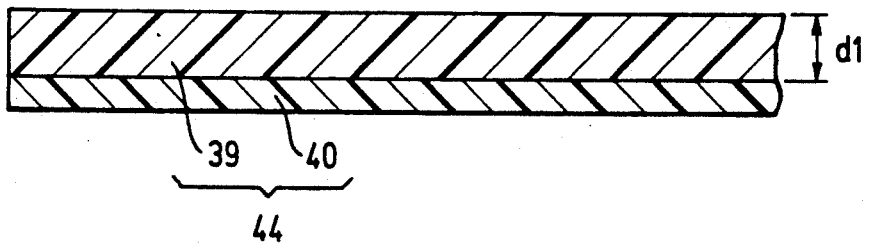
FIG. 8 is a sectional view of an adhesive tape 44.

FIG. 4 is a perspective view showing a part of a thermal head 11 in one of the embodiments of the invention, FIG. 5 is a sectional view as seen from cut section line 5—5 in FIG. 4, FIG. 6 is a plan view of the thermal head 11, and FIG. 7 is a sectional view as seen from cut section line 7—7 in FIG. 6. The thermal head 11 comprises a heat resistant substrate 12 of a flat plate made of a material possessing both electric insulating property and rigidity, such as alumina ceramics, and a heat reserve layer 13 is formed on the heat resistant substrate 12 by thick film technology such as screen printing, on a straight line along the longitudinal direction of the thermal head 11 (the vertical direction to the sheet of paper in FIG. 5). By the similar thick film technology, for example, a thick film common electrode 14 made of aluminum or the like is formed on the periphery of the heat resistant substrate 12.

A heating resistance element layer 15 is formed on them by thin film technology, such as sputtering and evaporation. On this heating resistance element layer 15, a thin film electrode layer 16 having penetration holes in predetermined plural regions is formed by the same thin film technology. The parts of the heating resistance element layer 15 opposite to these penetration holes are composed of heating elements 17 of the thermal head 11. In the thin film electrode layer 16, one common side of each heating element 17 is formed entirely as the commonly connected thin film common electrode 18, thereby composing a common electrode 19 together with the thick film common electrode 14. The thin film electrode layer 16 of the other side of each heating element 17 is divided in every heating element 17 to compose individual electrodes 20. A wear resistant layer 21 made of such material as silicon nitride is formed on the thin film electrode layer 16.

The heating resistant substrate 12 is mounted on a cooling board 22 made of a light alloy material such as aluminum alloy. In the heat resistant substrate 12, there is a first region 23 possessing a width W3 corresponding to the arrangement region of the heating elements 17, extending over the entire length in the longitudinal direction of the heat resistant substrate 12, and between this first region 23 and the cooling board 22, a cooling compound 24 is placed. The cooling compound 24 is a viscous greasy substance mixing particles of aluminum oxide, zinc oxide or the like with the particle size of 1 μm or less, and silicone oil.

In the cooling board 22 corresponding to the boundary of the first region 23 and the remaining second region 25, a pair of long grooves 26, 27 having a convex section, for example, are formed as groove parts along the longitudinal direction of the thermal head 11. Between the second region 25 and the cooling board 22, adhesive 28, 29 are placed. The adhesive 28, 29 may be either two-sided tape or one-sided having with a parting paper. That is, although the cooling compound 24 is an amorphous fluid, but the adhesives 28, 29 possess a specific shape, and have a film thickness d1.

The individual electrodes 20 are divided into a predetermined number, and connected to plural driving circuit elements 20 in each group. The driving circuit elements 30 selectively conduct the individual electrodes 20 at, for example, grounding potential, and the heating elements 17 are selectively conducted and heated, thereby printing.

To realize the operation of the driving circuit elements 30 mentioned above, control lines 31 are connected to the driving circuit elements 30. The thick film common electrode 14 is connected to a power supply circuit element 32. The plural driving circuit elements 30 are connected to this electric circuit element 32 through a power supply line 33. The control lines 31 are connected to a flexible wiring substrate 36 having a circuit wiring 35 formed on an electric insulating film 34, and the thick film common electrode 14, part of the power supply line 33 and power supply circuit element 32 may be disposed on the flexible wiring substrate 36.

Between the cooling plate 22 and the flexible wiring substrate 36, a heat resistant reinforcing plate 37 is intervening, and this reinforcing plate 37 is affixed to the cooling board 22 with the adhesive 28, and affixed to the flexible wiring substrate 36 with hard adhesive 38.

Figure 2:
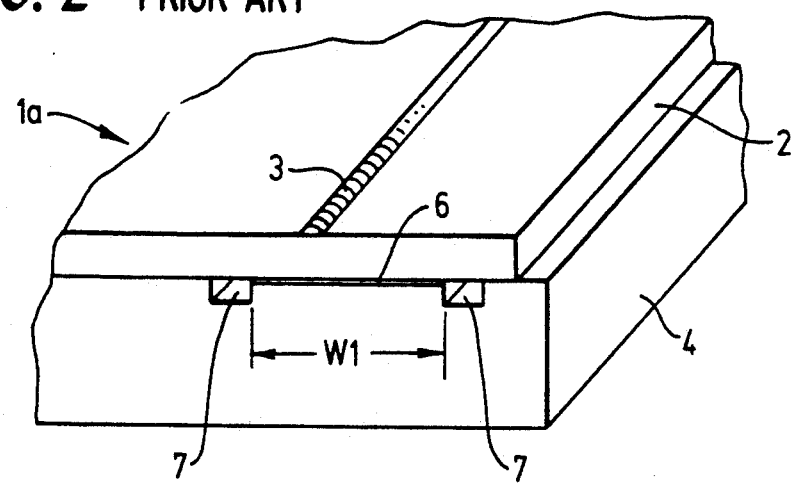
FIG. 2 PRIOR ART
FIG. 2 is a sectional view of a thermal head 1*a* of a second prior art.
Figure 3:
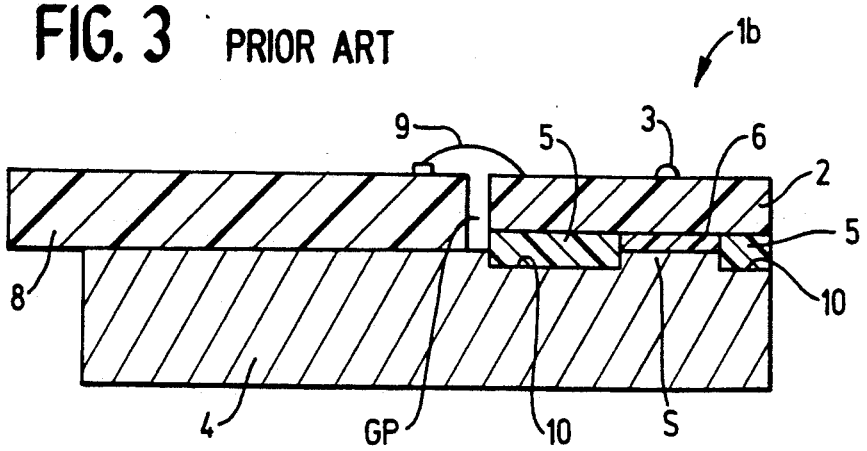
FIG. 3 PRIOR ART
FIG. 3 is a sectional view of a thermal head 1*b* of a third prior art.

In this embodiment, the layer thickness d1 of the adhesives 28, 29 is selected in a range of, for example, 10 micron to 150 micron. Accordingly, as heat is generated by the heating elements 17, as explained in reference to FIG. 1 in the description of the prior art, it is possible to restrict the warp of the heat resistant substrate 12 and cooling board 22 occurring in the direction vertical to the sheet of paper in FIG. 2 taking place between the heat resistant substrate 12 and cooling board 22 due to heat generation of the heating elements 17. That is, if the warps are less than 40 μm, as confirmed by the present inventors, the heat resistant substrate 12 and cooling board 22 do not contact with each other directly. In this case, since the heat conduction along the longitudinal direction of the thermal head 11 is almost uniform, the uneven contrast in printing may be canceled.

Besides, by selecting the material of the cooling compound 24 used in the layer thickness d1 at the thermal conductivity of 1.5 to $3.0\times10^{-3}$ cal/cm.sec.°C., as far as the layer thickness is d1, it has been confirmed by the present inventor that the same thermal conductivity as when the heat resistant substrate 12 is in direct contact with the cooling board 22 is realized. The cooling compound 24 is controlled to a film thickness d1 by the adhesives 28, 29, so that the thermal conductive action by the cooling compound 24 in this embodiment may be effectively realized.

In composing such thermal head 11, after applying the cooling compound 24 on the first region 23 of the cooling board 22 and forming the adhesives 28, 29, when the heat resistant substrate 12 is put on the cooling board 22, the excessive cooling compound 24 flows into the long grooves 26, 27, and will not flow into the second region 25 side. It is hence possible to prevent wetting of the part of the heat resistant substrate 12 and cooling board 22 opposite to the second region 25, and loss of tacky action of the adhesives 28, 29.

Figure 9:
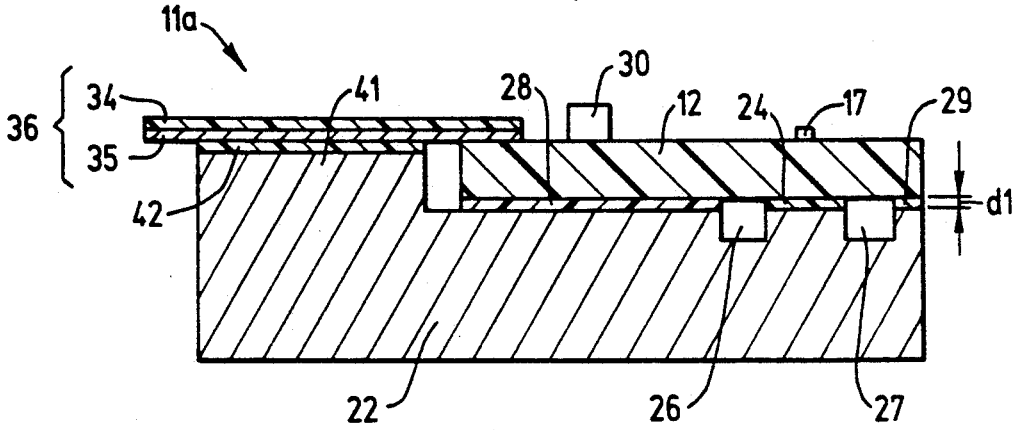
FIG. 9 is a sectional view of a thermal head 11*a* in a second embodiment of the invention.

FIG. 9 is a sectional view of a thermal head 11*a* in a second embodiment of the invention. This embodiment is described herein while referring to FIG. 9. This embodiment is similar to the foregoing one, and corresponding parts are identified with the same reference numbers. What is of note in this embodiment is that a support part 41 corresponding to the reinforcing plate 37 is formed on the cooling board 22, without using the reinforcing plate 37 in the thermal head 11 shown in FIG. 4, thereby affixing the flexible wiring substrate 36 mounted thereon by the adhesive 42. In such constitution, too, the same effects as in the foregoing embodiment may be achieved. At the same time, to a greater advantage, the number of parts may be reduced.

Figure 10:
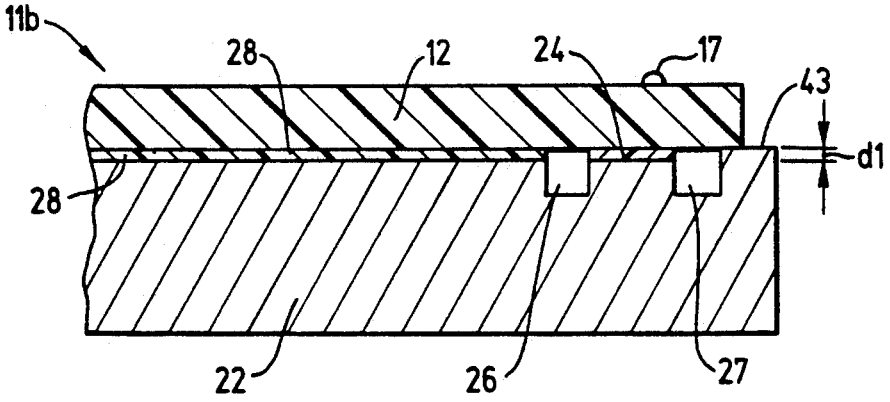
FIG. 10 is a sectional view of a thermal head 11*b* in a third embodiment of the invention.

FIG. 10 is a sectional view of a third embodiment of the invention. This embodiment is explained below while referring to FIG. 10. This embodiment is similar to the first embodiment, and the corresponding parts are identified with the same reference numbers. What is of note in this embodiment is that, in the cooling board 22, a supporting protrusion 43 extending to the heat resistant substrate 12 side by the portion of film thickness d1 from the shape in FIG. 5 is formed in the right side part of FIG. 2 from the long groove 27. In other words, protrusion 43 has a height nearly equal to the thickness of adhesive 28. Therefore, there is no adhesive between the support protrusion 43 and the heat resistant substrate 12. Even in such constitution, the same effects as in the foregoing embodiment may be realized.

The concave positions of the invention are not limited to the long grooves 26, 27, but may be plural slots or other shapes.

According to the invention, instead of the cooling compound 24, a cooling adhesive excellent in thermal conductivity, possessing rubbery elasticity after curing may be used (thermal conductivity $1.0\times10^{-3}$ cal/cm-.sec.°C. or more). For example silicone adhesives curing at room temperature, such as KE-3463 of Shin'etsu Chemical Industries, and SE4420 of Toray Silicone may be used.

The cooling compound or cooling adhesive used in the invention is selected to have the thermal conductivity of $1.0\times10-3$ cal/cm.sec.°C., or preferably $1.5\times10^{-3}$ cal/cm.sec.°C. or higher. If the thermal conductivity is less than $1.0\times10^{-3}$ cal/cm.sec.°C., the heat from the heating elements tends to be stagnant, and the picture quality may deteriorate.

As for the adhesive, the thickness is desired in a range of 10 micron to 150 micron, and as far as within this range, the difference in expansion between the heat resistant substrate and cooling member may be most effectively absorbed by the soft deformation of the adhesive itself, thereby securely preventing the warping due to bimetal effect caused by difference in coefficient of thermal expansion along temperature rise in printing action. It is also desired to use a soft adhesive of which shear adhesion strength is 25 kg/cm$^2$ or less. If the shear adhesion strength exceeds 25 kg/cm$^2$, the bimetal effect occurs to cause warp.

Figure 11:
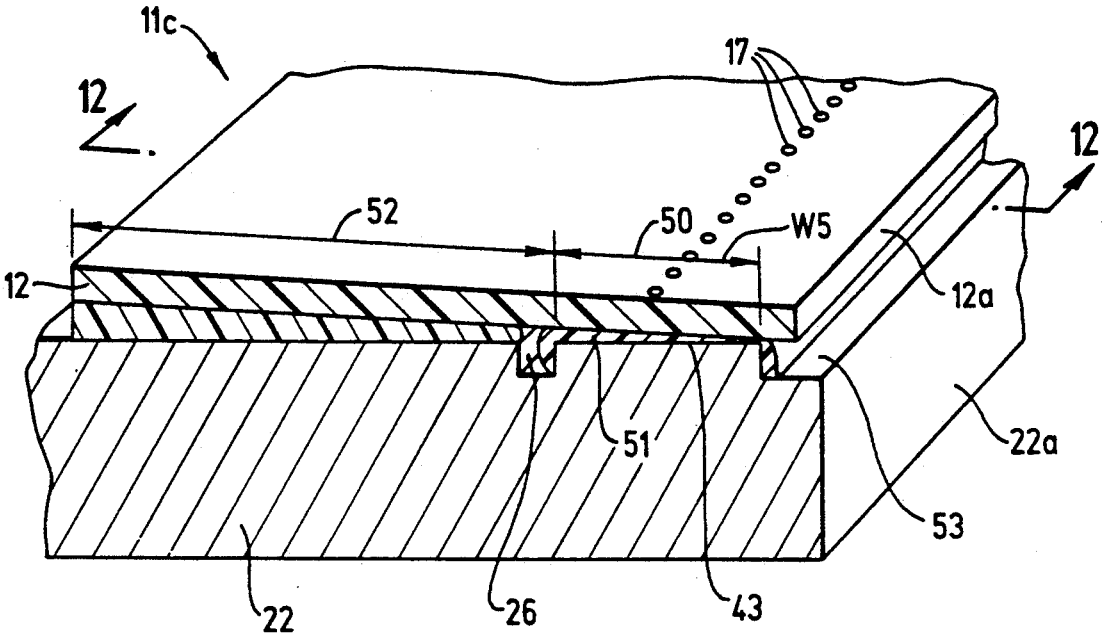
FIG. 11 is a partial oblique view of a thermal head 11 in a different embodiment of the invention.
Figure 12:
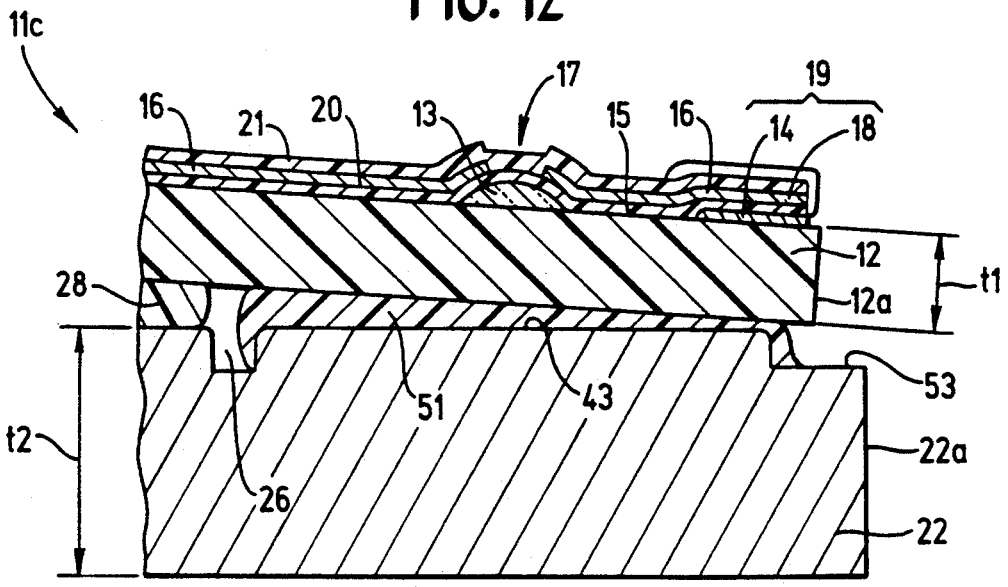
FIG. 12 is a sectional view of the thermal head 11*c*.
Figure 13:
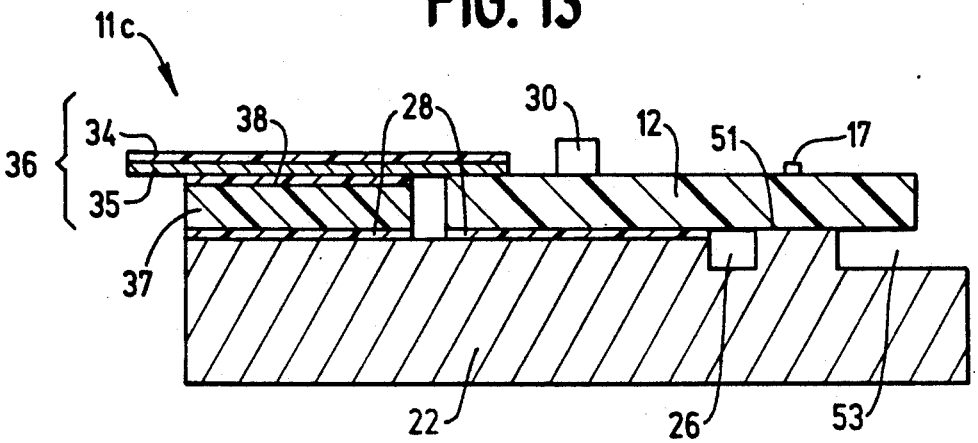
FIG. 13 is an overall sectional view of the thermal head 11*c*.

FIG. 11 is a perspective view showing a part of a thermal head 11*c* in other embodiment of the invention, FIG. 12 is a sectional view seen from cut section line 12—12 in FIG. 11, and FIG. 13 is an overall sectional view of the thermal head 11*c*. This embodiment is similar to the foregoing embodiments, and corresponding parts are identified with the same reference numbers. The thermal head 11*c* comprises a flat heat resistant substrate 12 in a plate thickness t1 (for example, 0.5 mm to 1.0 mm) made of a material possessing electric insulation and heat resistance such as alumina ceramics, and this heat resistant substrate 12 is put on a cooling board 22 in a plate thickness t2 (for example, 5 mm to 10 mm) made of a light alloy material such as aluminum alloy. The heat resistant substrate 12 comprises a first region 50 in a length extending the overall length in the longitudinal direction of the heat resistant substrate 12, with a width W5 including the arrangement position of heating elements 17, and an adhesive having a rubbery elasticity 51 excellent in thermal conductivity is intervening between this first region 50 and protrusion 43 formed in a range corresponding to the first region 23 on the cooling board 22. As this elastic adhesive 51, for example, a silicone adhesive with a thermal conductivity of $2.5\times10^{-3}$ cal/cm.sec (for example, SE4420 of Toray Dow Corning) is selected.

The area of the heat resistant substrate 12 other than the first region 50 is set as a second region 52, and in the boundary of the left side of FIG. 12 of the first region 50, therefore a long groove 26 in the length extending over the entire length of the heat resistant substrate 12 along the arrangement direction of heating elements 17, and in the part of the cooling board 22 on the opposite side of the long groove 26 with respect to the first region 50, a recess 53 is formed in the length over the entire length of the heat resistant substrate 12 in a range including the end part 22*a* of the cooling board 22, as a result the protrusion 43 is prescribed. Between the second region 52 and the cooling board 22, an acrylic resin adhesive (for example, No. 467 or 468 of Sumitomo 3M) 28 is placed. This adhesive 28 may be, for example, a two-sided tape or one-sided tape with a parting paper. That is, the elastic adhesive 51 is an amorphous fluid, while the adhesive 28 is a flat belt with a specific plate thickness t3 (for example, 0.125 mm).

Referring to FIG. 13, between the cooling board 22 and the flexible wiring substrate 36, a heat resistant reinforcing plate 37 is intervening, and this reinforcing plate 37 is fixed to the cooling board 22 with the adhesive 28, and to the flexible wiring substrate 36 with hard adhesive 38.

Figure 14:
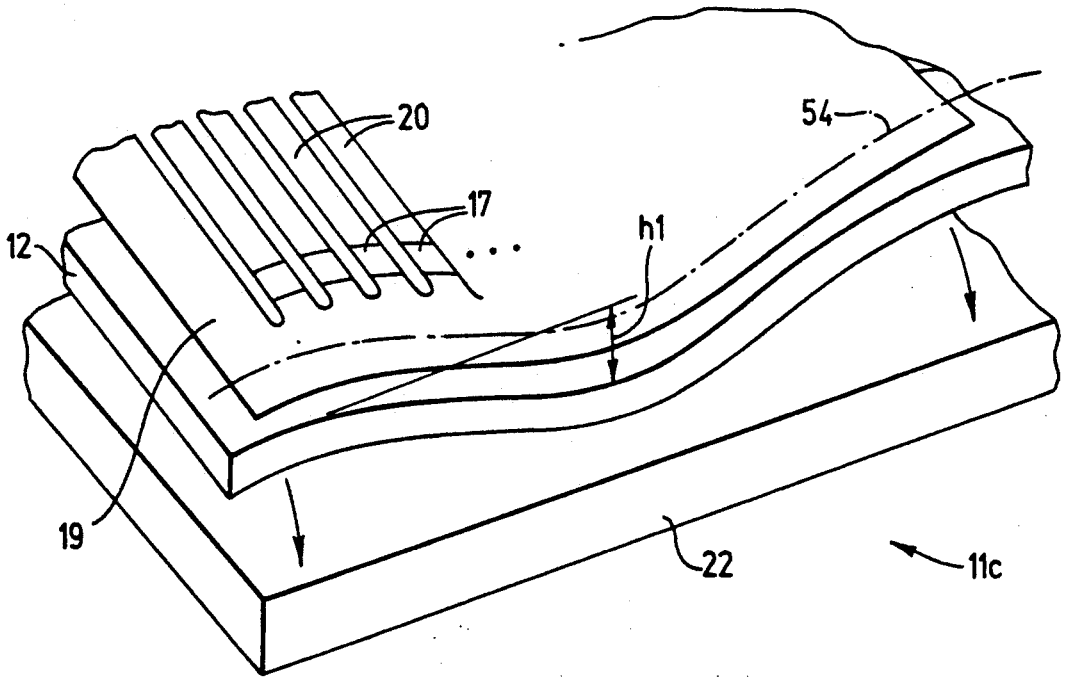
FIG. 14 is an oblique exploded view of the thermal head 11*c*.

FIG. 14 is an oblique exploded view of the thermal head 11*c*. The heat resistant substrate 12 is known to have waves and warps of height h1 of tens to hundreds of microns, for example, in its manufacturing process. Such waves and warps cause uneven thermal conductivity between the heat resistant substrate 12 and cooling board 22, thereby leading to uneven contrast in thermal printing as experienced in the prior art.

In this embodiment, therefore, when affixing the heat resistant substrate 12 to the cooling board 22 with elastic adhesive 51 and adhesive 28, the heat resistant substrate 12 is pressed tightly against the cooling board 22, by using a pressing jig having a triangular column made of rubber or similar material attached to a metallic bar, on a pressing region 54 on the common electrode 19, thereby eliminating the waves and warps, and the elastic adhesive 51 is cured in this state. This pressing region 54 is selected near the end 12*a* side of the first region 50 shown in FIG. 11.

Figure 15:
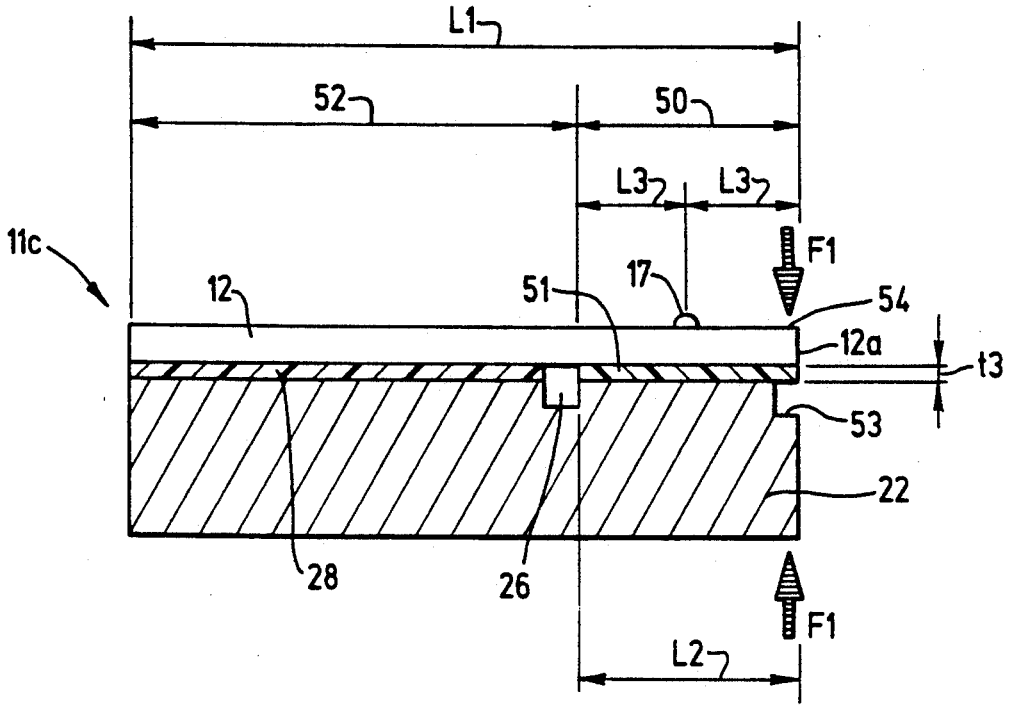
FIG. 15 and FIG. 16 are sectional views for explaining the pressing steps of this embodiment.
Figure 16:
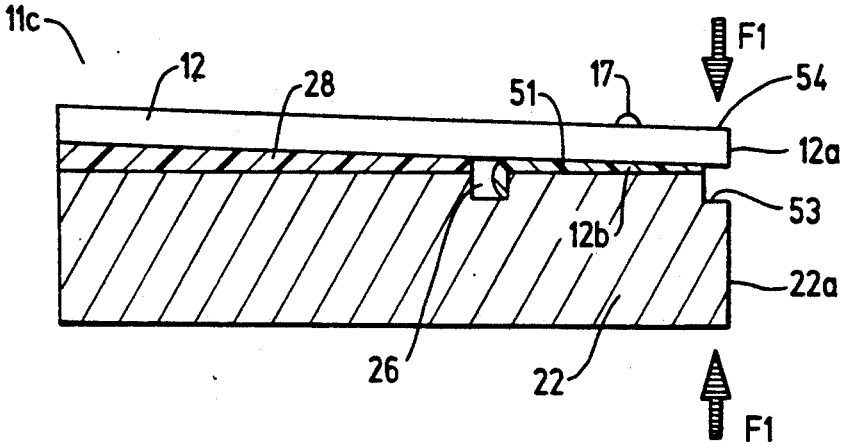
Figure 17:
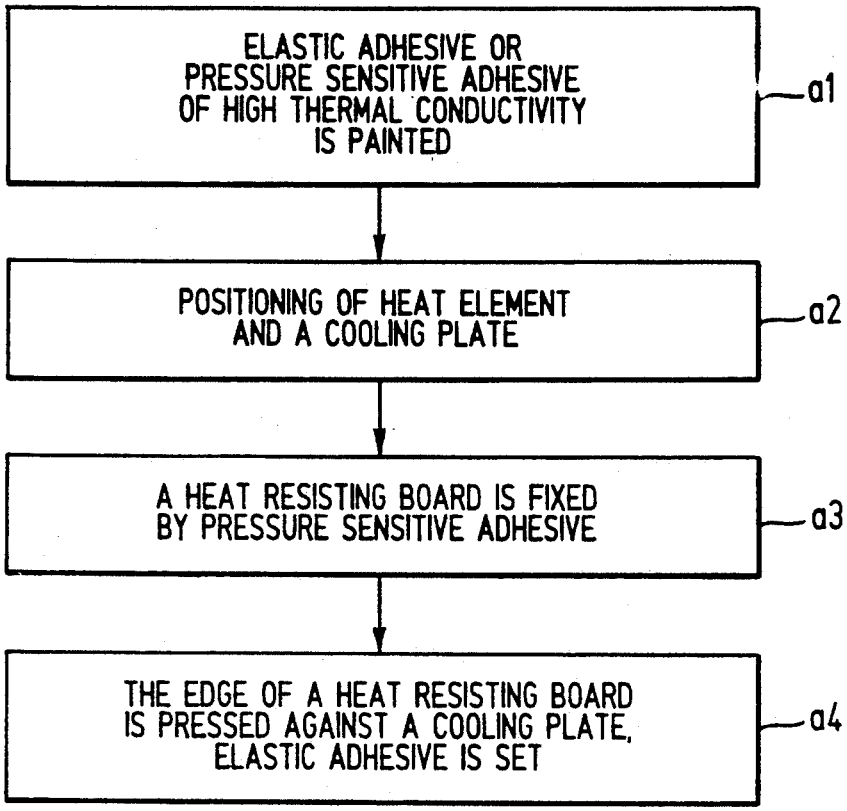
FIG. 17 is a process chart explaining the manufacturing process of the thermal head 11*c*.

FIG. 15 and FIG. 16 are drawings explaining such processing steps. As mentioned above, the adhesive 28 has a film thickness of t3, and therefore before the pressing step by the pressing jig, as shown in FIG. 15, the cooling board 22 and heat resistant substrate 12 are opposite to each other at a clearance of t3. Hereinafter, the manufacturing process of the thermal head 11*c* is explained while referring also to the process chart in FIG. 17. At step a1 in FIG. 17, an elastic adhesive 54 is applied in a length L2 (for example, 8 mm) and the adhesive 28 in the remaining range, in an area corresponding to the first region 50 and second region 52 on the cooling board 22 with overall length of L1 (for example, 25 mm). At this time, the heating elements 17 are disposed in the central position of the first region 50.

At step a2, the heating elements 17 on the heat resistant substrate 12 are positioned to as to be located in the central position of the portion of the cooling board 22 corresponding to the first region 50. At step a3, the heat resistant substrate 12 is affixed to the cooling board 22 with the adhesive 28. At step a4, by pressing the pressing region 54 near the end 12*a* part of the heat resistant substrate 12 shown in FIG. 15 with a force F1 as mentioned below, the lower side 12*b* of the end part 12*a* of the heat resistant substrate 12 is abutted against the upper side ridge of the end part 22*a* of the cooling board 22 as shown in FIG. 16. At this time, since the pressing action is applied in the pressing region 54 over the entire length of the heat resistant substrate 12 as shown in FIG. 14, the heat resistant substrate 12 of such plate thickness as t1 is easily deformed and flattened, so that warps and waves of the heat resistant substrate 12 are eliminated.

Afterwards, for example, the elastic adhesive 51 is cured by heating. At this time, the elastic adhesive 51 applied between the first region 50 and cooling board 22 oozes out of the first region 50 by the pressing action, but the long groove 26 and recess 53 are formed on the cooling board 22 at both sides of the subscanning direction of the first region 50 as shown in FIG. 11, the oozing excess elastic adhesive 51 flows into the long groove 26 and recess 53. As a result, loss of adhesive action by wetting of the adhesive 28 is prevented, and also hardening in the state of projecting out of the end parts 12, 22*a* of the heat resistant substrate 12 and cooling board 22 may be prevented at the same time.

To determine the pressing force F1, the prevent inventor experimented as follows.

Figure 18:
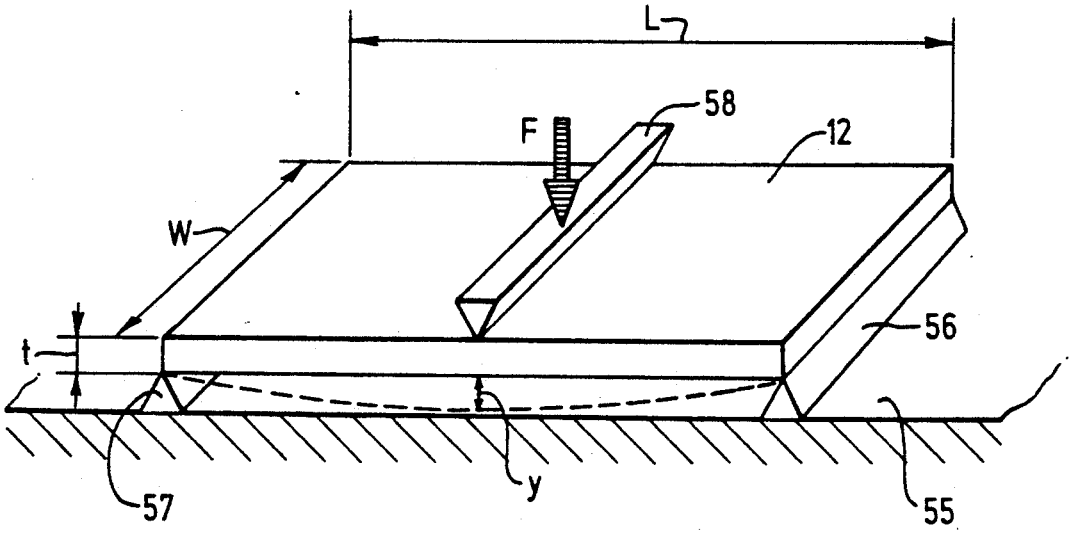
FIG. 18 is an oblique view showing the composition used in the experiment for determining the pressing force F.
Figure 19:
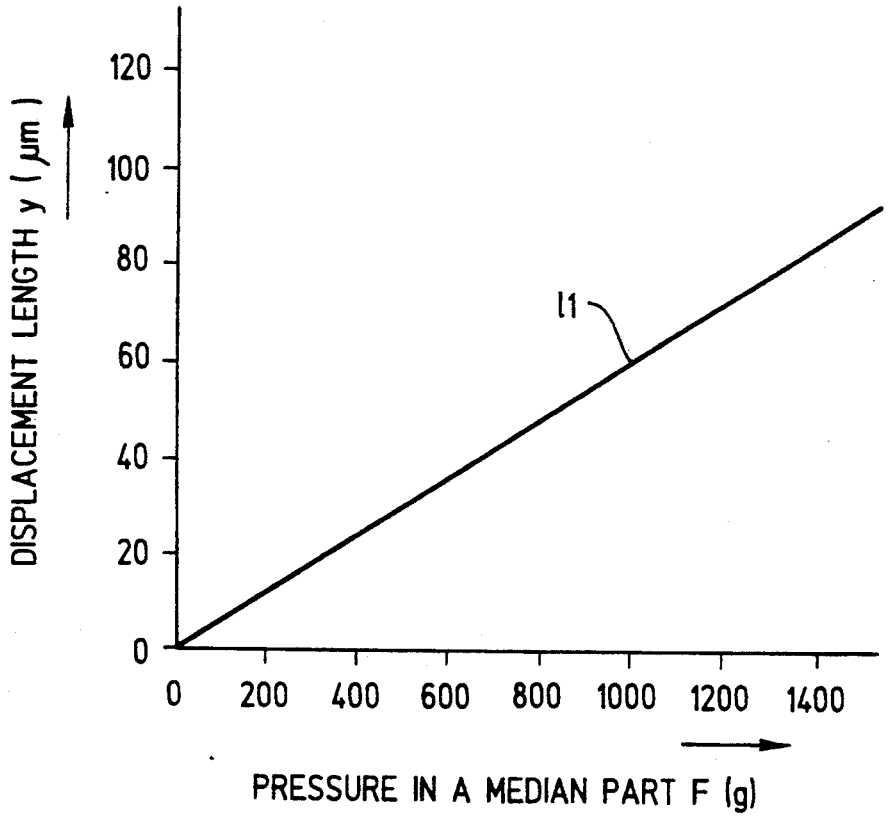
FIG. 19 is a graph showing the relation between the pressing force F and the displacement y.

As shown in FIG. 18, the heat resistant substrate 12 made of, for example, alumina ceramics, with the plate thickness of $t=0.635$ mm, width $2=10.0$ mm, length $L=30$ mm, and Young's modulus of $4.0\times10^7$ g/mm$^2$, is supported on a flat plane 55, with the both ends held in the ridges of the support pieces 56, 57 of triangular column shape, and pressed with a force F at the ridges by using a pressing piece 58 of triangular column shape in the middle of the support pieces 56, 57 of the heat resistant substrate 12. The relation between the pressing force F at this time and the displacement y of the heat resistant substrate 12 was measured. The result is shown in FIG. 19. It was thus verified that there is a linear relation as expressed by line l1 between the pressing force F (g) and the displacement y ($\mu$m). That is, if the height h1 of warps and waves of the heat resistant substrate 12 is, for example, 80 $\mu$m, the pressing force F is enough at about 1300 g.

In such thermal head 11*c* of this embodiment, the vicinity of the end part 12*a* in which the heating elements 12 of the heat resistant substrate 12 are formed is pressed to the cooling board 22 to eliminate warps and waves, and hence thermal conductivity from the heat resistant substrate 12 to the cooling board 22 is made uniform along the arrangement direction of the heating elements 17. It is therefore possible to avoid uneven contrast in thermal printing due to preventing uneven heat reserve in the heat resistant substrate 12, so that the printing quality may be improved by far. At the same time, the distance between the portion immediately beneath the heating elements 17 of the heat resistant substrate 12 and the cooling board 22 may be suppressed to, for example, about ½ as compared with the interval t3 shown in FIG. 15 before the pressing process. Accordingly, the thermal conduction from the heat resistant substrate 12 to the cooling board 22 is outstandingly enhanced. Therefore, even in the case of continuous printing by using the thermal head 11*c* of this embodiment, the heat reserve in the heat resistant substrate 12 is decreased, and a sharp image with an excellent contrast may be realized, and in this respect, too, the printing quality may be improved greatly.

In this embodiment, the shape of the protrusion 43 of the cooling board 22 to be coated with the elastic adhesive 51 may be either flat at the end opposite to the heat resistant substrate 12, or pointed toward the heat resistant substrate 12.

The invention may be embodied in other specific form without departing form the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A thermal head comprising:

a heat resistant substrate member having front and rear major surfaces, said rear major surface having first and second regions spaced from one another in a first direction, and heating elements mounted on said front major surface in line with said first region;

a cooling member disposed adjacent said rear major surface of said substrate member, said cooling member having a major surface with a first portion facing said first region of said rear major surface of said substrate member and a second portion facing said second region of said rear major surface of said substrate member;

an elastic material having a high heat conductivity disposed between said first region of said rear major surface of said substrate member and said first portion of said cooling member major surface; and an adhesive disposed between said second region of said rear major surface in said second region of said substrate member and said second portion of said cooling member major surface, wherein said cooling member is provided with at least one groove in said major surface of said cooling member said groove being located between said first and second regions for separating said elastic material from said adhesive.

2. A thermal head according to claim 1, wherein the adhesive has a layer thickness of 10 micron to 150 micron, and shearing adhesion strength of 25 kg/cm or less.

3. A thermal head according to 1, wherein the elastic material is a cooling compound composed of a greasy matter with a thermal conductivity of $1.0\times10^{-3}$ cal/cm.sec. °C. or more.

4. A thermal head according to claim 1, elastic wherein the material is a silicone adhesive with a thermal conductivity of $1.0\times10^{-3}$ cal/cm.sec.°C. or more.

5. A thermal head according to claim 1, further comprising: circuit wiring for feeding driving electric power to the heating elements formed on the front major surface of the heat resistant substrate member; a flexible wiring substrate connected to said circuit wiring; and a reinforcing member disposed in the cooling member and supporting said flexible wiring substrate, the reinforcing member having a thickness which is nearly the same as the thickness of the heat resistant substrate member.

6. A thermal head according to claim 1, further comprising: circuit wiring for feeding driving electric power to the heating elements formed on the front major surface of the heat resistant substrate member; a flexible wiring substrate connected to said circuit wiring; and wherein said cooling member is provided with a support part for supporting the flexible wiring substrate in a flat state.

7. A thermal head according to claim 1, wherein the elastic material is a silicone resin adhesive with a thermal conductivity of $1.0\times10^{-3}$ cal/cm.sec.°C. or more.

8. A thermal head of claim 1, wherein the heat resistant substrate member is made of an elastic material with a Young's modulus of $4.0\times10^{7}$ g/mm$^2$ or less.

9. A thermal head according to claim 1, wherein: said heating elements extend in said first direction; said rear major surface has two said second regions located at opposite sides of said first region; there are two said grooves in said cooling mentor each interposed between said first region and a respective second region; and said adhesive is provided at each of said second regions.

10. A thermal head according to claim 1, wherein said adhesive is constituted by a layer having a thickness, and one of said members is provided with a protrusion extending toward the other said member in said second region, said protrusion having a height substantially equal to the thickness of the adhesive layer.

11. A thermal head according to claim 1, wherein said elastic material is a cooling compound having a rubbery elasticity.

12. A thermal head according to claim 1, wherein said elastic material is an adhesive.

13. A thermal head according to claim 1, wherein said groove is provided in said major surface of said cooling member.

* * * * *